United States Patent [19]

Proud

[11] 4,379,982

[45] Apr. 12, 1983

[54] LOW ENERGY STARTING AID FOR HIGH INTENSITY DISCHARGE LAMPS

[75] Inventor: Joseph M. Proud, Wellesley, Mass.

[73] Assignee: GTE Laboratories Incorporated, Waltham, Mass.

[21] Appl. No.: 345,866

[22] Filed: Feb. 4, 1982

Related U.S. Application Data

[63] Continuation of Ser. No. 193,786, Oct. 2, 1980, abandoned.

[51] Int. Cl.[3] ..... H01J 7/44; H01J 17/34; H01J 19/78; H01J 29/96

[52] U.S. Cl. ..... 315/73; 307/106; 315/60; 315/74; 315/263

[58] Field of Search ..... 315/60, 43, 263, 234, 315/330, 335, 45, 46, 47, 72, 73, 74, 75, 100, 104; 333/140; 307/106

[56] References Cited

U.S. PATENT DOCUMENTS 3,982,154 9/1976 Mize et al. ..... 315/60
4,004,188 1/1977 Cooper ..... 315/263
4,139,805 2/1979 Cosco et al. ..... 315/234
4,297,616 10/1981 Corona ..... 315/234
4,322,658 3/1982 Minarczyk ..... 315/60

*Primary Examiner*—Saxfield Chatmon, Jr.
*Attorney, Agent, or Firm*—J. Stephen Yeo

[57] ABSTRACT

A light source, including a high pressure discharge lamp and a starting pulse generator, such as a spiral line pulse generator, utilizes a generally straight elongated conductor, or starting aid, in close proximity to an outer surface of the discharge tube to provide efficient coupling of the starting pulse to the discharge lamp. The starting aid extends between a region proximate one of the electrodes and a region proximate the other of the electrodes. The starting aid provides within the discharge lamp an ionization path of minimum length free of circumferential turns when the conductor is energized by the pulse generator. The starting aid can be affixed to the discharge tube or can be mounted in one or more support brackets.

2 Claims, 12 Drawing Figures

LOW ENERGY STARTING AID FOR HIGH INTENSITY DISCHARGE LAMPS

This is a continuation of application Ser. No. 193,786 filed Oct. 2, 1980, now abandoned.

CROSS REFERENCE TO RELATED APPLICATION

Proud et al, "Method and Apparatus For Starting High Intensity Discharge Lamps", U.S. Pat. application Ser. No. 193,878, filed concurrently with the present application and assigned to the same assignee as the present application, contains claims to portions of the subject matter herein disclosed.

BACKGROUND OF THE INVENTION

This invention relates to starting of high intensity discharge lamps and, more particularly, to new and improved apparatus for efficiently coupling high voltage, short duration pulses to high intensity discharge lamps.

High intensity discharge lamps, such as high pressure sodium lamps, commonly include noble gases at pressures below 100 torr. Lamps containing noble gases at pressures below 100 torr can be started and operated by utilizing an igniter in conjunction with a lamp ballast. The lamp ballast converts the ac line voltage to the proper amplitude and impedance level for lamp operation. The igniter provides pulses which assist in initiating discharge. The igniter is a relatively large and heavy circuit and is typically built into or located near the lamp ballast.

It has been found that the inclusion in high pressure sodium lamps of xenon as the noble gas at pressures well in excess of 100 torr is beneficial to lamp performance. However, the pulse energy requirements for starting of the discharge lamp increase as the pressure of the xenon included within the lamp increases and the conventional igniter described above does not, by itself, produce reliable starting. Various approaches to starting discharge lamps containing high pressure xenon have been taken. A high voltage pulse is typically coupled to the discharge tube by a conductor known as a starting aid, as shown in U.S. Pat. No. 4,179,640 issued Dec. 18, 1979 to Larson et al. The starting aids shown in the prior art have had the form of a wire wrapped around the discharge tube in a spiral configuration or a wire harness surrounding the discharge tube.

Starting aid configurations which more efficiently couple the starting pulse to the discharge lamp are desirable for several reasons. When starting pulse energy requirements are reduced by efficient coupling, the physical size and cost of the starting pulse generator circuit can be reduced. Physical size of the starting circuit is of particular importance when it is desired to include the starting circuit within the outer jacket of the lamp. Alternatively, more efficient coupling of the starting pulse facilitates starting of discharge lamps having higher starting pulse energy requirements.

SUMMARY OF THE INVENTION

It is an object of the present invention to provide new and improved apparatus for efficiently coupling high voltage, short duration pulses to high intensity discharge lamps.

It is another object of the present invention to provide starting wire configurations for high intensity discharge lamps which require minimal pulse energy for the initiation of discharge.

According to the present invention, these and other objects and advantages are achieved in a light source including a high pressure discharge lamp, pulse generating means, and an elongated conductor for coupling electrical energy from the pulse generating means to the discharge lamp. The high pressure discharge lamp includes a discharge tube having electrodes sealed therein at opposite ends for receiving ac power and encloses a fill material which emits light during discharge. The pulse generating means is operative to provide at an output thereof a high voltage, short duration pulse of predetermined energy. The elongated conductor is coupled to an output of the pulse generating means and is disposed in close proximity to an outer surface of the discharge tube in a configuration which provides within the discharge tube an ionization path of minimum length, free of circumferential portions, between the electrodes when the conductor is energized by the pulse generating means.

In a preferred embodiment, the elongated conductor includes a generally straight portion extending between a region proximate one of the electrodes and a region proximate the other of the electrodes. The elongated conductor can be affixed to the outer surface of the discharge tube or can be mounted in one or more support brackets.

DETAILED DESCRIPTION OF THE INVENTION

Figure 1:
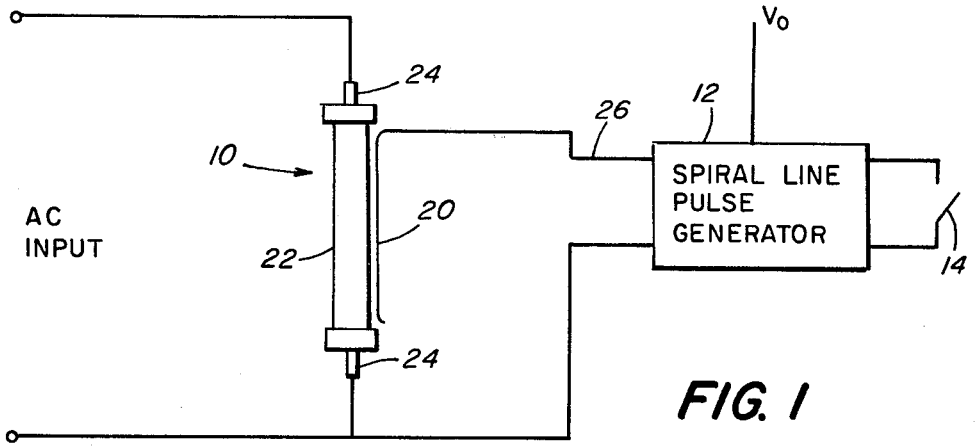
FIG. 1 is a schematic diagram of a light source according to the present invention.

A high intensity light source is shown in FIG. 1 and includes a high pressure discharge lamp 10, a spiral line pulse generator 12, a switch 14, and an elongated conductor 20. The discharge lamp 10 is a high pressure sodium lamp and includes a discharge tube 22, typically made of alumina or other transparent ceramic material, having electrodes 24 sealed therein at opposite ends. The discharge tube 22 encloses a fill material, typically including sodium or a sodium amalgam and a noble gas or mixtures of noble gases, which emits light during discharge. The electrodes 24 receive ac power from a lamp ballast at a voltage and current suitable for operation of the discharge lamp 10. An output 26 of the spiral line pulse generator 12 is coupled to one end of the conductor 20, typically a fine wire, which is located in close proximity to an outer surface of the discharge tube 22. The configuration of the conductor 20 is of importance in efficient starting of the light source of FIG. 1 and is described in greater detail hereinafter. The spiral line pulse generator 12 receives electrical energy from a source of voltage $V_0$ which can be the ac input to the discharge lamp 10. The switch 14 is coupled to the spiral line pulse generator 12. In a manner which is fully described hereinafter, the spiral line pulse generator 12, after closure of the switch 14, provides at its output a high voltage, short duration pulse which initiates discharge in the discharge lamp 10.

Figure 2:
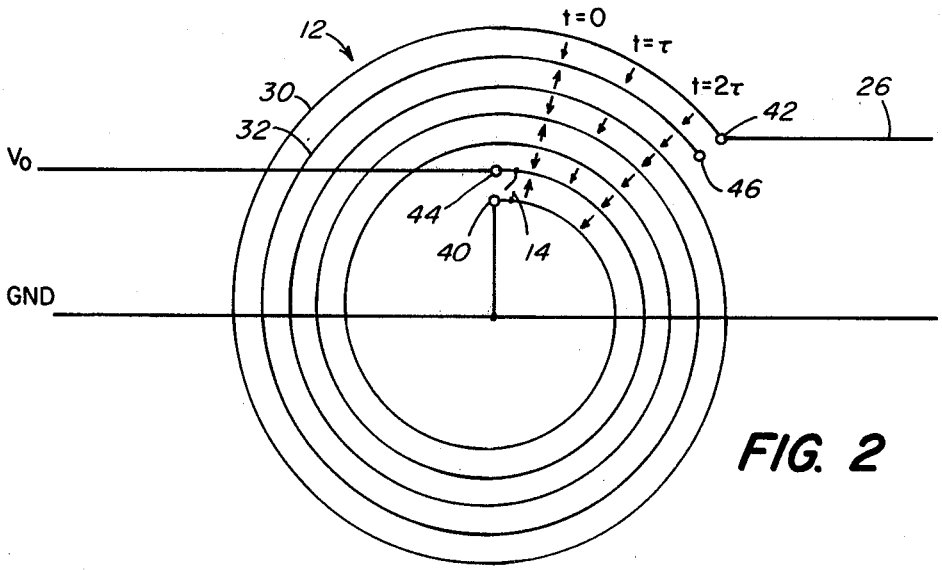
FIG. 2 is a simplified schematic diagram of a spiral line pulse generator.
Figure 3:
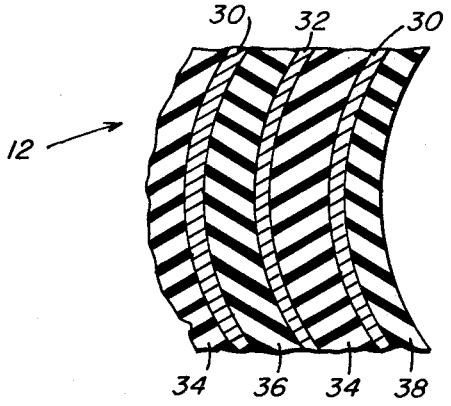
FIG. 3 is a partial cross-sectional view of the spiral line pulse generator shown in FIG. 2.

The spiral line pulse generator 12 is shown in simplified form in FIG. 2 for ease of understanding. A pair of conductors 30 and 32 in the form of elongated sheets of conductive material are rolled together to form a multiple turn spiral configuration. FIG. 3 is a partial cross-sectional view of the spiral line pulse generator 12 illustrating the layered construction of the device. A four layered arrangement of alternating conductors and insulators, including the conductors 30 and 32 and a pair of insulators 34 and 36, is rolled onto a form 38 in a multiple turn spiral configuration. The form 38 provides mechanical rigidity. The conductors 30 and 32 are separated by dielectric material at every point in the spiral configuration.

Figure 4:
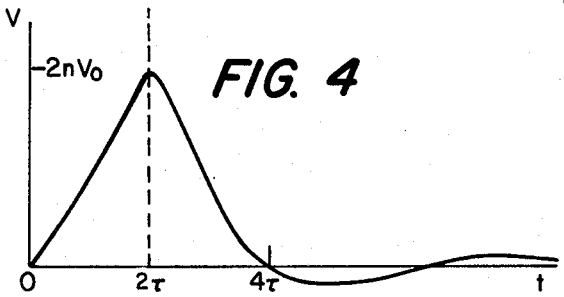
FIG. 4 is a graphic representation of the voltage output of the spiral line pulse generator of FIG. 2.

The operation of the spiral line pulse generator 12 can be described with reference to FIG. 2, which schematically shows the conductors 30 and 32. The conductor 30 runs from point 40 to point 42 while the conductor 32 runs from point 44 to point 46. In the present example, the switch 14 is coupled between the conductors 30 and 32 at or near the points 40 and 44. A voltage $V_0$ is applied between the conductors 30 and 32. Prior to the closing of the switch 14, the conductor 30 has a uniform potential between the points 40 and 42 and the conductor 32 has a uniform potential between the points 44 and 46 and the voltage difference between the innermost and the outermost turns of the spiral configuration is at most $V_0$. This can be seen by summing the electric field vectors at time $t=0$ as shown in FIG. 2. When the switch 14 is rapidly closed, a field reversing wave propagates along the transmission line formed by the conductors 30 and 32. When the wave reaches the points 42 and 46, at time $t=\tau$, the potential difference between the points 42 and 46 is $nV_0$, where n is the number of turns in the spiral configuration, due to the absence of cancelling static field vectors. As is well known, the propagating wave undergoes an in-phase reflection at the points 42 and 46 when these points are terminated in a high impedance or are open circuited as shown in FIG. 2. This results in an additional increase in the potential difference between the innermost and outermost conductors with a maximum occurring at time $t=2\tau$ at which time the field vectors are aligned as shown in FIG. 2. The output voltage waveform of the spiral line pulse generator 12 is shown in FIG. 4. The output taken between point 42 or 46 and point 40 reaches a maximum voltage of $2nV_0$ at $t=2\tau$ after the closure of the switch 14. The operation of the spiral line pulse generator is described in further detail in U.S. Pat. No. 3,289,015 and in Fitch et al, Novel Principle of Transient High Voltage Generation, Proc. IEE, Vol. 111, No. 4, April 1964.

The operation and properties of the spiral line pulse generator 12 can be expressed in terms of the following parameters:

$V_o$ Charging voltage
$V_m$ Peak pulse voltage
n Number of turns
V(t) Transient voltage waveform
$\tau$ Transit time in spiral line
D Diameter of spiral
v Velocity of propagation in spiral
W Width of line composing spiral
d Thickness of dielectric
c Velocity of EM waves in vacuum
$C_o$ Static capacitance of line
C Effective output capacitance
$Z_o$ Impedance of line composing spiral
k Relative dielectric constant
$\epsilon_o$ Dielectric constant in vacuum
$\eta$ Permeability of vacuum
L Inductance of fast switch
$\delta$ Thickness of build-up
E Energy available in spiral line Relationships descriptive of the output pulse are given by:

$$V_m=2nV_o \tag{1}$$

$$V(t)=(nt/\tau)V_o \qquad 0<t<2\tau \tag{2}$$

$$V(t) = 2n\left(1-\frac{t-2\tau}{2\tau}\right)V_o \; 2\tau < t < 4\tau \tag{3}$$

$$\tau = n\pi D/v, \; v = ck^{-\frac{1}{2}} \tag{4}$$

The capacitance of the spiral line and its effective output capacitance are given by:

$$C_o=\pi nk\epsilon_o DW/d \tag{5}$$

$$C=C_o/(2n)^2 \tag{6}$$

The stored energy is:

$$E=C_oV_o^2/2 \tag{7}$$

The characteristic impedance of the strip line composing the spiral is:

$$Z_o=(\mu/\epsilon)^{\frac{1}{2}}d/W \tag{8}$$

In optimizing performance of the spiral line pulse generator 12, it is important to utilize low loss dielectric materials and conductors in order that the propagating wave maintain a fast risetime compared to the transit time $\tau$ of electromagnetic waves between the innermost turn and the outermost turn of the spiral line pulse generator. It is additionally important to maintain a large ratio of diameter to winding buildup ($D/\delta$) and to provide for a very low inductance switch to insure that the voltage between the conductors is switched in a time interval which is much shorter than $\tau$. The maximum permissible value of inductance for the switch 14 is determined from the approximation known in the art that closure risetime is approximately equal to $L/Z_o$. Therefore, the following inequality must be met:

$L << \tau Z_o$. For a typical design, L, the inductance of the switch, is on the order of one nanohenry or less.

As discussed hereinafter, it is preferable to include the spiral line pulse generator 12 within an outer jacket of the light source. In this situation, the spiral line pulse generator 12 must meet certain additional requirements. It is important that the spiral line pulse generator 12 have a compact physical size. Furthermore, when the spiral line pulse generator 12 is included within the outer jacket of the light source, it must be capable of withstanding the considerable heat generated by the discharge lamp. In a typical application, the spiral line pulse generator 12 must be capable of operation at 200° C.

It has been determined that the energy content, rather than the amplitude or pulse width, of the spiral line pulse generator output pulse is the most important factor in effective starting of high pressure discharge lamps. The discharge lamp can be started by output pulses of less than ten kilovolts in amplitude by increasing the energy content of the pulse. Since output pulses of maximum amplitude and minimum duration are not necessarily required, the spiral line pulse generator design requirements and the switch speed requirements described hereinabove can be relaxed.

In one example of a spiral line pulse generator, the conductors were aluminum foil having a thickness of 0.0007" and a width of 0.5" and the insulators were polyimide film dielectric having a thickness of 0.00048" and a width of 1". The two conductors, separated by the two insulators, were wound on a cylindrical form having a diameter of 0.7". Approximately 130 turns provide a capacitance of approximately 0.5 microfarad. The insulators were wider than the conductors to prevent arcing between turns at the edges of the conductors. Typically, the voltage, ground, and output connections are made by means of tabs which are spot welded to the conductors during the winding of the spiral line pulse generator. When 200 volts is applied to this spiral line pulse generator, an output pulse of approximately 3500 volts and 30 nanoseconds is provided.

The low inductance switch 14, which is shown in FIG. 2 connected between the conductors 30 and 32 on the innermost turn of the spiral line pulse generator 12, can alternatively be connected between the conductors 30 and 32 on the outermost turn at or near the points 42 and 46 or between the conductors 30 and 32 at the midpoint of the conductors 30 and 32. While the output voltage can be taken between any two points on the spiral line pulse generator 12, the maximum voltage multiplication factor is obtained when the output is taken between the innermost turn and the outermost turn.

Figure 5:
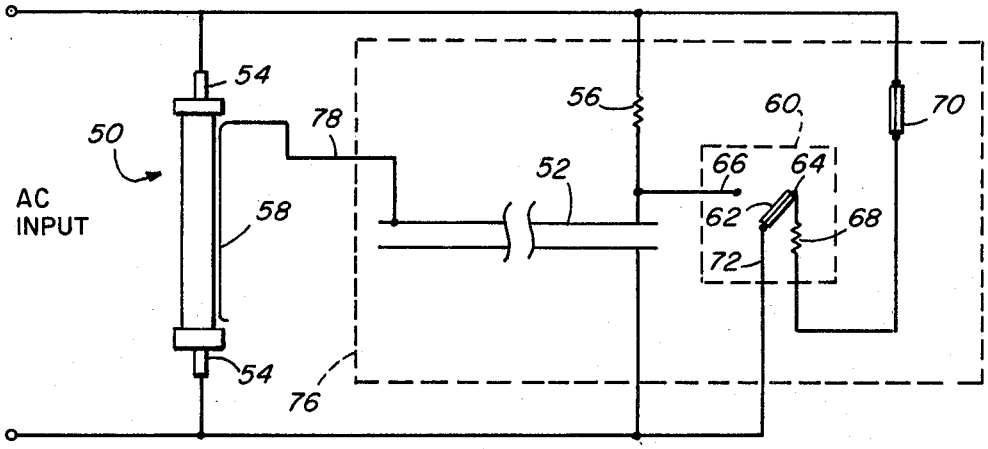
FIG. 5 is a schematic diagram of a light source which provides automatic starting.

A light source configuration providing automatic operation is illustrated in schematic form in FIG. 5. A discharge lamp 50 corresponds exactly to the discharge lamp 10 shown in FIG. 1 and described hereinabove. A spiral line pulse generator 52 shown symbolically in FIG. 5 corresponds to the spiral line pulse generator 12 shown in FIGS. 1, 2, and 3 and described hereinabove. AC power is coupled to electrodes 54 at opposite ends of the discharge lamp 50 and is coupled through a current limiting resistor 56 to one end of one conductor of the spiral line pulse generator 52. The output of the spiral line pulse generator 52 is coupled to one end of a conductor 58 located in close proximity to an outer surface of the discharge lamp 50 but not coupled to the electrodes 54. Alternatively, the output of the spiral line pulse generator can be coupled to the electrodes 54 of the discharge lamp 50 in which case the ac power is coupled through a filter circuit to block the high voltage pulse from the source of power. A self-heated thermal switch 60 includes a bimetallic switch 62 having a normally closed contact 64 and a normally open contact 66 and further includes a heater element 68. The normally open contact 66 of the bimetallic switch 62 is coupled to the one conductor of the spiral line pulse generator 52. The normally closed contact 64 of the bimetallic switch 62 is coupled through the heater element 68 and through a normally closed disabling switch 70 to the ac input. A common contact 72 of the bimetallic switch 62 and the other conductor of the spiral line pulse generator 52 are coupled to ground. The disabling switch 70 is a bimetallic switch which is located in proximity to the discharge lamp 50 and senses the temperature of the discharge lamp 50. A starting circuit 76, comprising the spiral line pulse generator 52, the resistor 56, the thermal switch 60, and the disabling switch 70, has an output 78, which is the output of the spiral line pulse generator 52, coupled to the conductor 58.

In operation, when ac power, typically provided by a lamp ballast, is applied to the light source of FIG. 5, the spiral line pulse generator 52 is charged through the resistor 56. At the same time, current flows through the switch 70, the heater 68 and the bimetallic switch 62, thus increasing the temperature of the heater element 68. The heater element 68 is in close proximity to the bimetallic switch 62 and causes heating of the bimetallic switch 62. When the heater element 68 reaches a predetermined temperature, the bimetallic switch 62 switches from normally closed contact 64 to normally open contact 66. The closure of normally open contact 66 provides a short circuit across the conductors of the spiral line pulse generator 52, thus producing at the output of the spiral line pulse generator 52 a high voltage, short duration pulse which initiates discharge in the discharge lamp 50. The heat produced by the discharge in the lamp 50 causes the disabling switch 70 to open, thereby disabling the thermal switch 60.

If, for any reason, the first spiral line pulse generator 52 output pulse did not initiate discharge in the discharge lamp 50, the switch 70 remains in the closed position and the bimetallic switch 62 cools since the heater element 68 is no longer energized. When the bimetallic switch 62 cools to a predetermined temperature, it switches back to the normally closed contact 64 and current again flows through the heater element 68. The temperature of the heater element 68 and the bimetallic switch 62 again rises and causes switching of the bimetallic switch 62 to the normally open contact 66 and a second high voltage, short duration pulse is generated by the spiral line pulse generator 52. This process continues automatically until a discharge is initiated in the discharge lamp 50. At that time, the increase in temperature of the discharge lamp 50 causes the switch 70 to open and the thermal switch 60 to be disabled. As discussed hereinabove, the bimetallic switch 62 must provide a low inductance short circuit across the spiral line pulse generator 52 for optimum performance of the spiral line pulse generator 52. The configuration of FIG. 5 provides automatic generation of starting pulses until a discharge is initiated in the discharge lamp 50.

Figure 6:
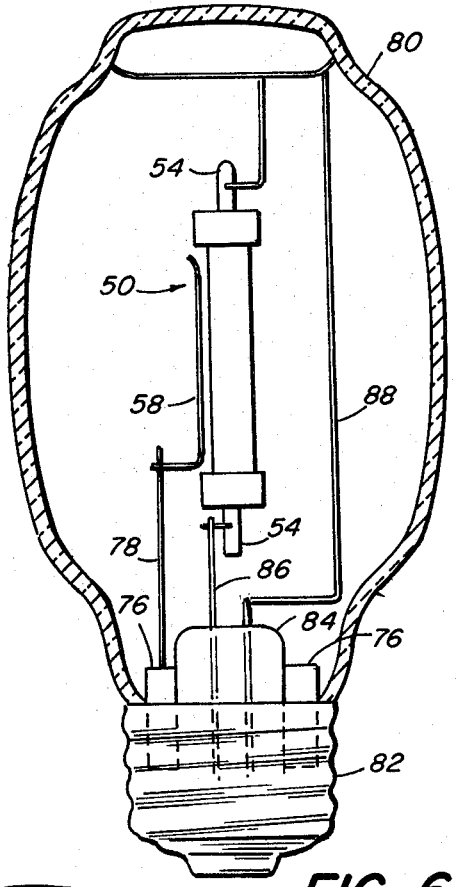
FIG. 6 is an elevational view of a light source according to the present invention wherein the starting circuit is included within the outer jacket.

A physical embodiment of the light source shown in schematic form in FIG. 5 is illustrated in FIG. 6. The discharge lamp 50 is enclosed by a light transmitting outer jacket 80. Power is received by a lamp base 82 and conducted through a lamp stem 84 by conductors 86 and 88 to the electrodes of the discharge lamp 50. The conductors 86 and 88 are sufficiently rigid to provide mechanical support for the discharge lamp 50. The starting circuit 76 is located in the base region of the outer jacket 80 surrounding the lamp stem 84. This location of the starting circuit 76 is chosen to minimize blockage of light emitted by the discharge lamp 50. The starting circuit 76 includes the spiral line pulse generator 52, the resistor 56, the thermal switch 60 and the switch 70 connected as shown in FIG. 5. The output 78 of the starting circuit 76 is coupled to the conductor 58 which is located in close proximity to an outer surface of the discharge lamp 50. The location of the starting circuit 76 as shown in FIG. 6 is advantageous because the generally cylindrical shape of the spiral line pulses generator 52 is compatible with the annular space available in the lamp base. When very high energy levels are required to start the discharge lamp 50, the spiral line pulse generator 52 can become too large for inclusion within the outer jacket 80. In this instance, the starting circuit 76 can be located external to the outer jacket 80, for example, in the light fixture in which the light source is mounted. The pulse energy requirements for starting of the discharge lamp 50 increase as the pressure of the noble gas included within the lamp increases. For example, a lamp having a xenon pressure of about 10 torr requires a starting pulse of approximately 2 to 5 millijoules while a lamp having a xenon pressure of about 300 torr requires a starting pulse of approximately 70 to 100 millijoules. The igniter commonly used in high pressure sodium lamp ballasts does not provide pulses of sufficient voltage to start lamps containing noble gases at pressures above about 100 torr. Therefore, such lamps cannot be used in standard high pressure sodium lamp fixtures. In the configuration shown in FIG. 6, the starting circuit 76 is included within the outer jacket 80 of the light source and is tailored for effective starting of the discharge lamp 50. Therefore, the light source shown in FIG. 6 can be used with standard high pressure sodium lamp ballasts. Furthermore, since the starting circuit is self-contained within the light source, the configuration of FIG. 6 can be utilized with mercury lamp ballasts, which do not contain an igniter.

Figure 7:
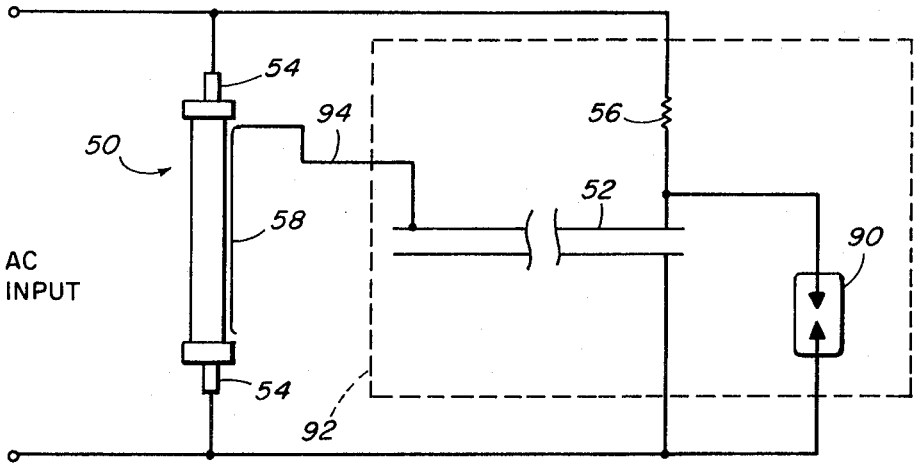
FIG. 7 is a schematic diagram of another light source which provides automatic starting.

An alternative light source configuration providing automatic operation is illustrated in schematic form in FIG. 7. The discharge lamp 50 and the spiral line pulse generator 52 are connected as shown in FIG. 5 and described hereinabove except that the thermal switch 60 and the disabling switch 70 of FIG. 5 are replaced by a spark gap 90. The spark gap 90 is a two terminal device which is connected directly across the conductors of the spiral line pulse generator 52. The spark gap 90 is normally an open circuit but switches to a short circuit when a voltage greater than a predetermined value is applied to the device. In FIG. 7, the predetermined firing voltage of the spark gap 90 is selected to be slightly less than the peak ac input voltage so that the spiral line pulse generator 52 achieves maximum output voltage. A starting circuit 92, including the spiral line pulse generator 52, the resistor 56, and the spark gap 90, has an output 94 coupled to the conductor 58. The starting circuit 92 can replace the starting circuit 76 shown in the light source of FIG. 6.

Figure 8A:
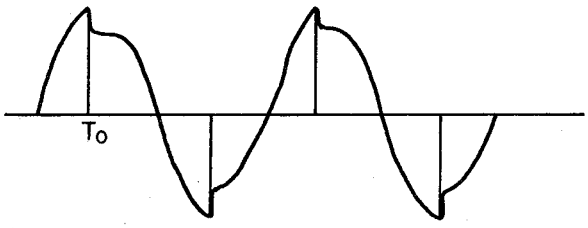
FIGS. 8A and 8B are graphic representations of voltage waveforms which occur in the light source of FIG. 7.
Figure 8B:
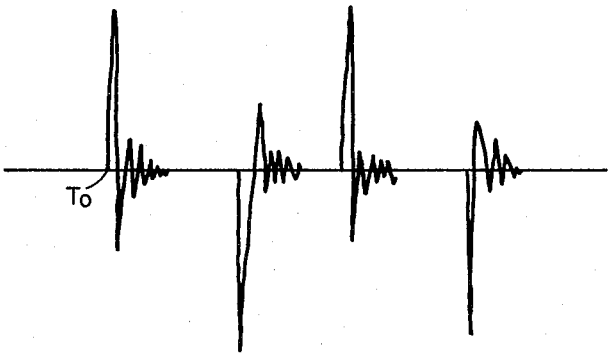

In operation, an ac voltage, typically provided by a lamp ballast, is applied to the configuration of FIG. 7. The voltage across the spiral line pulse generator 52, illustrated in FIG. 8A, increases until the firing voltage of the spark gap 90 is reached at time $T_o$. The spark gap 90 rapidly short circuits the spiral line pulse generator 52 and a high voltage, short duration pulse, illustrated in FIG. 8B, is provided at the output of the spiral line pulse generator 52 at time $T_o$, as described hereinabove. By repetition of this process, a high voltage pulse is produced by the spiral line pulse generator on each half cycle of the ac input voltage, as shown in FIG. 8B, until starting of the discharge lamp 50. After the discharge lamp 50 is started, the voltage supplied by the lamp ballast to the light source is reduced and the spark gap 90 does not fire.

The configuration of FIG. 7 provides several advantages. (1) Starting pulses are produced when maximum potential exists across the discharge lamp 50, thus maximizing the probability of starting. (2) Starting pulses are produced at 120 Hz until starting occurs. (3) The starting circuit stops functioning automatically after the discharge lamp 50 starts. (4) The number of circuit components is minimal.

As noted hereinabove, the configuration of the conductor 20 in FIG. 1 and the conductor 58 in FIGS. 5–7 is of importance in efficient starting of the light source described herein. Conductors, such as the conductors 20 and 58, used for starting of discharge lamps are commonly referred to as starting aids. By providing efficient transfer of energy from the spiral line pulse generator to the discharge lamp, the energy required in the output pulse of the spiral line pulse generator can be reduced. A reduction in energy requirements is beneficial in two ways. For a given discharge lamp, the size of the spiral line pulse generator can be reduced, thus resulting in easier packaging of the spiral line pulse generator and lower cost. Second, a given spiral line pulse generator can be used to start discharge lamps with higher noble gas pressures.

Figure 9A:
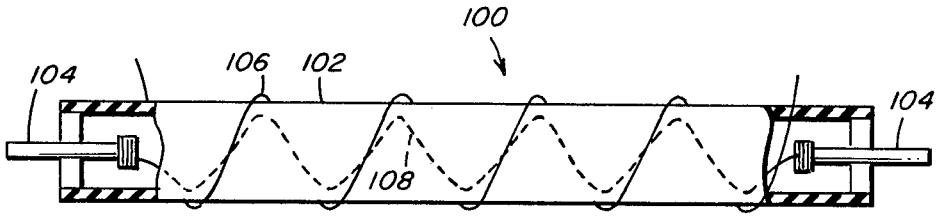
FIG. 9A PRIOR ART
FIGS. 9A and 9B are elevational views, partly in cross section, of high intensity discharge lamps illustrating starting aid configurations according to the prior art.

Various starting aid configurations are known in the prior art. Referring now to FIG. 9A, there is shown a discharge lamp 100, corresponding to the discharge lamp 10 shown in FIG. 1 and described hereinabove. The discharge lamp 100 includes a light transmitting discharge tube 102 having electrodes 104 sealed therein at opposite ends. A starting aid 106, in the form of a fine wire, is wrapped around the outer surface of the discharge tube 102 in a spiral configuration having several turns. The starting aid 106 is coupled at its ends to a pulse generator. Upon application of a high voltage, short duration pulse to the starting aid 106, an ionization path 108 is formed in the interior of the discharge lamp 100 between the electrodes 104. The ionization path 108 follows the path of the starting aid 106 and therefore is spiral in configuration.

Figure 9B:
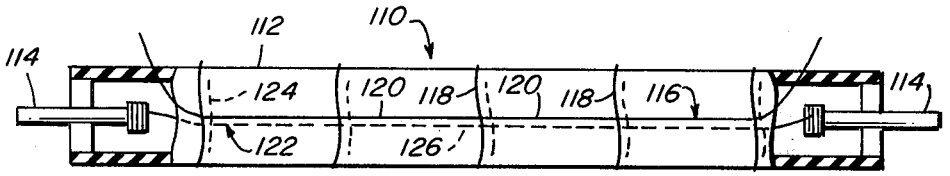
FIG. 9B PRIOR ART

A similar configuration of a starting aid according to the prior art is shown in FIG. 9B. A discharge lamp 110, corresponding to the discharge lamp 10 shown in FIG. 1 and described hereinabove, includes a discharge tube 112 having electrodes 114 sealed therein at opposite ends. A starting aid 116, in the form of a conductive wire harness, is disposed around the outer surface of the discharge tube 112. The starting aid 116 includes a number of circumferential portions 118 which surround the discharge tube 112 and a number of interconnecting portions 120 which connect the circumferential portions 118, thus forming a harness. When a high voltage, short duration pulse is applied to the starting aid 116, an ionization path 122 is formed within the discharge tube 112 between the electrodes 114. The ionization path 122 follows the path of the conductor which forms the starting aid 116. Thus, the ionization path 122 includes portions 124 which follow the circumferential portions 118 of the starting aid 116, and portions 126 which follow the interconnecting portions 120 of the starting aid 116.

Figure 10:
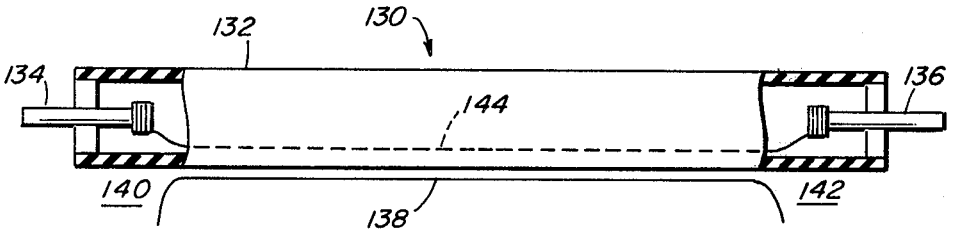
FIG. 10 is an elevational view, partly in cross section, of a high intensity discharge lamp illustrating a low energy starting aid configuration.

It has been found that the use of a straight wire starting aid results in superior starting of high intensity discharge lamps. Referring now to FIG. 10, there is shown a discharge lamp 130, corresponding to the discharge lamp 10 shown in FIG. 1 and described hereinabove. The discharge lamp 130 includes a transparent discharge tube 132 having electrodes 134 and 136 sealed therein at opposite ends. A starting aid 138, in the form of an elongated conductor in a generally straight configuration, is located in proximity to an outer surface of the discharge tube 132. The starting aid 138 is coupled to a generator of high voltage, short duration pulses and runs in a generally straight path between a region 140 proximate the electrode 134 and a region 142 proximate the electrode 136.

The starting aid 138 can be mounted in proximity to the discharge tube 132 in any convenient manner which does not appreciably block the light output of the discharge lamp 130. For example, insulating support brackets can be located at opposite ends of the discharge lamp 130. When the conductor which forms the starting aid 138 is of sufficient diameter to have mechanical rigidity, a single insulating support bracket can be used. Alternatively, the starting aid 138 can be affixed to the outer surface of the discharge tube 132 by cement capable of withstanding the heat generated by the discharge lamp 130.

When a high voltage, short duration pulse, such as that generated by the spiral line pulse generator described hereinabove, is applied to the starting aid 138, an ionization path 144 is formed in the interior of the discharge lamp 130 between the electrodes 134 and 136. The ionization path 144 follows the path of the starting aid 138 and thus runs in a generally straight path between the electrodes 134 and 136. The formation of the ionization path 144 is dependent upon the peak pulse voltage applied to the starting aid 138. Whether the degree of ionization develops further to form an arc discharge between the electrodes 134 and 136 depends upon the initial conductivity of the ionization path 144. Conductivity in turn depends on the degree of ionization and electron temperature and is directly related to the energy initially supplied by the starting pulse. Thus, very narrow high voltage pulses can, in some cases, produce ionization but can fail to produce sufficient conductivity in the ionization path 144 to induce further development of a self-sustained discharge. In contrast to the ionization path 108 in FIG. 9A and the ionization path 122 in FIG. 9B, the ionization path 144 in FIG. 10 is free of extraneous circumferential turns. As a result, the length of the ionization path 144 is less than either of the ionization paths 108 or 122, and less pulse energy is required to establish conditions suitable for arc formation or starting of the discharge lamp 130.

The reduction in requisite pulse energy has been shown by experiment to be roughly a factor of two for the starting aid 138, shown in FIG. 10, as compared with the starting aids shown in FIGS. 9A and 9B. This is generally consistent with the reduction achieved in the length of the ionization path by utilizing a straight starting aid. Using the prior art starting aid configuration illustrated in FIG. 9B, it has been found that high pressure sodium lamps containing 200 torr xenon pressure require 35 kilovolt, 20 millijoules pulses, when the pulses are approximately 10 nanoseconds in width. A high pressure sodium lamp containing 300 torr xenon cannot be started within a reasonable voltage range using the starting aid shown in FIG. 9B. When the starting aid 138, as shown in FIG. 10, is utilized, experiment has shown that a discharge tube containing 200 torr xenon can be started with a 25 kilovolt, 10 millijoules pulse of 10 nanosecond pulse width. The straight starting aid 138, shown in FIG. 10, enables reliable starting of high pressure sodium discharge lamps containing 300 torr xenon with 33 kilovolt, 15 millijoules pulses at a pulse width of 10 nanoseconds.

It is to be understood that while the starting aid 138, shown in FIG. 10, has been described in connection with a spiral line pulse generator, a starting aid having a generally straight configuration can be used with any pulse generator capable of generating the requisite high voltage, short duration pulses. The starting aid 138 is of particular importance when it is desired to minimize the size of the pulse generator or when it is desired to start discharge lamps having high energy starting requirements.

Thus, there is provided by the present invention a light source in which a spiral line pulse generator provides starting pulses of sufficient energy to start a discharge lamp containing high pressure noble gases. The spiral line pulse generator reduces the mass and volume associated with inductive starting circuits. In addition, the spiral line pulse generator has a physical configuration which can advantageously be included within a discharge lamp envelope.

While there has been shown and described what is at present considered the preferred embodiments of the invention, it will be obvious to those skilled in the art that various changes and modifications may be made therein without departing from the scope of the invention as defined by the appended claims.

What is claimed is:

1. A light source comprising:

a high pressure discharge lamp including a discharge tube having first and second electrodes sealed therein at opposite ends for receiving ac power and enclosing a fill material which emits light during discharge;

pulse generating means operative to provide at an output thereof a high voltage, short duration pulse of predetermined energy; and a conductor including a generally straight portion extending from a region proximate to one of said electrodes towards a region proximate to the other of said electrodes coupled to said output of said pulse generating means and disposed in close proximity to an outer surface of said discharge tube for providing within said discharge tube an ionization path between said electrodes when said conductor is energized by said pulse generating means at which time said first electrode is at a first voltage potential, said second electrode is at a second voltage potential, and said conductor is at a third voltage potential higher than said first and second potential, wherein:

said high pressure discharge lamp is a high pressure sodium discharge lamp;

said fill material contains approximately 200 torr xenon pressure; and said pulse generator means provides a pulse of approximately 25 kilovolts for a duration of approximately 10 nanoseconds of approximately 10 millijoules energy.

2. A light source comprising:

a high pressure discharge lamp including a discharge tube having first and second electrodes sealed therein at opposite ends for receiving ac power and enclosing a fill material which emits light during discharge;

pulse generating means operative to provide at an output thereof a high voltage, short duration pulse of predetermined energy; and a conductor including a generally straight portion extending from a region proximate to one of said electrodes towards a region proximate to the other of said electrodes coupled to said output of said pulse generating means and disposed in close proximity to an outer surface of said discharge tube for providing within said discharge tube an ionization path between said electrodes when said conductor is energized by said pulse generating means at which time said first electrode is at a first voltage potential, said second electrode is at a second voltage potential, and said conductor is at a third voltage potential higher than said first and second potential, wherein:

said high pressure discharge lamp is a high pressure sodium discharge lamp;

said fill material contains approximately 300 torr xenon pressure; and said pulse generator means provides a pulse of approximately 33 kilovolts for a duration of approximately 10 nanoseconds of approximately 15 millijoules energy.

* * * * *